United States Patent [19]

Dambre

[11] Patent Number: 4,829,760

[45] Date of Patent: May 16, 1989

[54] COMPACT STEEL CORD STRUCTURE

[75] Inventor: Paul Dambre, Kemmel, Belgium

[73] Assignee: N.B. Bekaert S.A., Zwevegem, Belgium

[21] Appl. No.: 184,684

[22] Filed: Apr. 22, 1988

[30] Foreign Application Priority Data

May 4, 1987 [EP] European Pat. Off. ..... 200821

[51] Int. Cl.[4] ..... B60C 9/00; D07B 1/06; D02G 3/12; D02G 3/48

[52] U.S. Cl. ..... 57/212; 57/213; 57/218; 57/902; 152/451; 152/527; 152/556

[58] Field of Search ..... 51/210, 212, 213, 218, 51/219, 214, 902; 152/556, 557, 451, 527

[56] References Cited

U.S. PATENT DOCUMENTS

| | | | |
|---|---|---|---|
| 2,435,772 | 2/1948 | Clarke . | |
| 3,358,435 | 12/1967 | Peene | 57/218 |
| 3,538,702 | 11/1970 | Wolf et al. | 57/218 |
| 4,332,131 | 6/1982 | Palsky et al. | 57/902 X |
| 4,488,587 | 12/1984 | Umezawa et al. | 57/902 X |
| 4,572,264 | 2/1986 | Umezawa et al. | 152/451 |
| 4,707,975 | 11/1987 | Umezawa | 57/212 |

FOREIGN PATENT DOCUMENTS

| | | |
|---|---|---|
| 0168858 | 1/1986 | European Pat. Off. . |
| 0169588 | 1/1986 | European Pat. Off. . |
| 0194011 | 9/1986 | European Pat. Off. . |
| 2157204 | 11/1977 | Fed. Rep. of Germany . |

*Primary Examiner*—John Petrakes

*Attorney, Agent, or Firm*—Foley & Lardner, Schwartz, Jeffery, Schwaab, Mack, Blumenthal & Evans

[57] ABSTRACT

A steel cord comprises a central bundle of three twisted steel filaments (1) with a diameter $d_1$ and nine steel filaments twisted around said central bundle with the same twist pitch and twist direction as the central bundle. Three filaments (2) of said nine steel filaments have a diameter $d_2$ and contact two adjacent steel filaments of the central bundle. Six steel filaments (3) of said nine steel filaments have a diameter $d_3$ and contact both one steel filament of the central bundle and one steel filament of the three filaments with diameter $d_2$. The ratio $d_2/d_1$ is greater than 1.05 and smaller than 1.16. The raio $d_3/d_1$ is greater than $-0.205=0.814\times d_2/d_1$ and smaller than $-0.105+0.814=d_2/d_1$.

5 Claims, 2 Drawing Sheets

COMPACT STEEL CORD STRUCTURE

The invention relates to a steel cord adapted for the reinforcement of rubber articles such as rubber tyres.

A steel cord adapted for the reinforcement of rubber articles conveniently comprises steel filaments having a carbon content of more than 0.60 percent by weight (e.g. more than 0.65%, 0.78%, 0.82% or 0.95%). A typical steel composition is: a minimum carbon content above 0.65%, a manganese content between 0.40% and 0.70%, a silicon content between 0.15% and 0.30% and a maximum sulphur and maximum phosphorus content of 0.03%, all percentages being percentages by weight. Other, more expensive, elements such as chromium may also be alloyed. The diameter of such adapted steel filament lies in the range of 0.05 mm to 0.80 mm, preferably in the range of 0.05 mm to 0.40 mm (e.g. 0.08 mm, 0.16 mm or 0.31 mm). The elongation at rupture of a steel filament adapted for the reinforcement of rubber articles is at least 1%, preferably at least 2.5%. The steel filaments are usually provided with a coating which promotes the adherence of the steel wire to rubber articles. Such a coating conveniently comprises copper, zinc, brass or ternary brass alloy, or a combination of two or more different layers thereof. The thickness of the coating ranges from 0.05 to 0.40 micron, preferably from 0.12 to 0.22 micron. The coating can also be present in the form of a thin film of chemical primer material for ensuring good rubber penetration and adhesion.

In this respect compact steel cords have been developed for the reinforcement of rubber articles. A compact steel cord is a steel cord, all the composing steel filaments of which have the same twist direction and twist pitch and have contacts with adjacent steel filaments. Compact steel cords present in comparison with other cord structures several advantages: a compact steel cord can be manufactured within one single process step as can be derived from U.S. Pat. No. 4,332,131. A second advantage is that the composing steel filaments have line contacts with each other. However, compact steel cords have also many drawbacks. They have core migration and the breaking load per cord cross-section is rather low. The breaking load per cord cross-section is defined as the load necessary to break the cord divided by the surface of the circumscribed circle. Low values of the breaking load per cross-section bring about large cord diameters and consequently thick rubber plies and a small number of steel cords per rubber ply. Still another drawback of compact cords is a low fatigue limit especially caused by fretting wear between filaments of the same layer.

According to the prior art there have been several attempts to avoid the phenomenon of core migration. In patent application EP No. 0169.588 (a) there has been shown a steel cord twisting structure where wire migration is reduced by changing the relative position of the steel filaments of the central bundle. In patent application EP No. 0168.858 (b) there has been shown a steel cord where the diameter and twist pitch of the core wires is substantially different from the diameter and twist pitch of the filaments of the layer. In these applications (a) and (b) the problem of core migration is solved. However, the steel cord structures according to these applications (a) and (b) depart from the compact cord structure as defined herein, i.e. a cord the filaments of which have the same twist direction and twist pitch and showing nothing but line contacts between each other.

A compact steel cord structure which tackles the problem of fretting wear is disclosed in patent application EP No. 0194011: the layer around the core comprises at least one filament having a diameter which is less than the diameter of the core filaments. However, the breaking load per cross-section is still rather low.

According to the invention there is provided a steel cord adapted for the reinforcement of rubber articles, said steel cord comprising a central bundle of three twisted steel filaments of a diameter $d_1$ and nine steel filaments twisted around said central bundle with the same twist pitch and twist direction as said central bundle, a first group of three steel filaments of said nine steel filaments having a diameter $d_2$ and each filament of said first group contacting the two adjacent steel filaments of the central bundle, a second group of six steel filaments of said wire steel filaments having a diameter $d_3$ and each filament of said second group contacting both one steel filament of the central bundle and one steel filament of said first group, characterized in that the ratio $d_2/d_1$ is greater than 1.05 and smaller than 1.16 and in that the ratio $d_3/d_1$ is greater than $-0.205+0.814\times d_2/d_1$ and smaller than $-0.105+0.814\times d_2/d_1$.

A central bundle of three filaments having a diameter $d_1$ means that the deviation of the diameter of each of the three filaments is not greater than three percent of the mean value of the diameter $d_1$. The same applies—mutatis mutandis—for the first group of three filaments having a diameter $d_2$ and for the second group of six filaments having a diameter $d_3$.

The mean values of the diameters $d_1$, $d_2$, $d_3$ are used for the ratios $d_2/d_1$ and $d_3/d_1$.

The ratio $d_2/d_1$ must be smaller than 1.16 in order to avoid core migration, and must be greater than 1.05 in order to have a high value of the breaking load per cross-section.

The ratio $d_3/d_1$ must be greater than $-0.205+0.814\times d_2/d_1$ and smaller than $-0.105+d_2/d_1$ in order to have a cross-section that has a sufficient roundness as defined herein below.

The steel cord according to the invention may or may not be wrapped around by a single steel filament. This single steel filament may have a diameter different from the diameters $d_1$, $d_2$ and $d_3$. The wrapping direction or the wrapping pitch or both are different from resp. the twisting direction and the twisting pitch of the other steel filaments. The wrapping pitch is preferably smaller than the twisting pitch of the other steel filaments.

The invention also relates to a rubber product reinforced with a steel cord as defined herein above. This rubber product may be a tyre. The steel cord according to the invention is then located in a belt or carcass ply of the tyre.

The invention will now be described in more detail with reference to the accompanying drawings wherein.

Figure 1:
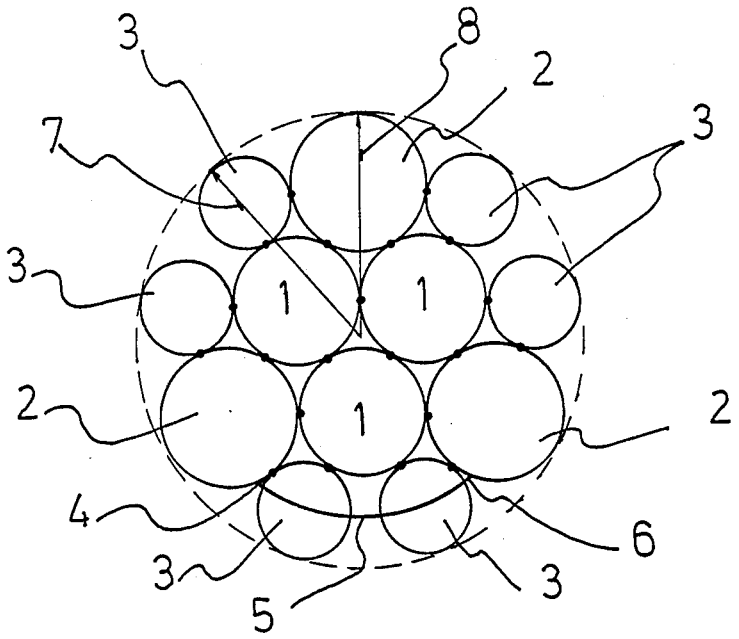
FIG. 1 represents a first example of a cross-section of a steel cord according to the invention.

Referring to FIG. 1 three twisted steel filaments 1, having a diameter $d_1$, are forming the central bundle of a steel cord according to the invention. Nine steel filaments, designated by 2 and 3, are twisted around the central bundle in the same twist direction and with the same twist pitch as the central bundle. Three steel filaments 2 have a diameter $d_2$ and contact two adjacent steel filaments 1 of the central bundle. Six steel filaments 3 have a diameter $d_3$ and contact both one steel filament 1 of the central bundle and one steel filament 2. The steel cord structure according to the invention shows an openness for the steel filaments 2 and 3. In order to have a sufficient rubber penetration the following ratio $$\frac{\text{distance 4} + \text{distance 5} + \text{distance 6}}{\text{distance 4} + \text{distance 5} + \text{distance 6} + 2\,d_3}$$

must be greater than 0.10, preferably greater than 0.15. Distances 4-5-6 are measured along a circle with the same centre as the cross-section of the steel cord structure and going through the centre of the cross-section of steel filaments 3. $2\ d_3$ is an approximation of the distances along this circle corresponding with the cross-section of the steel filaments 3. If the ratio $d_2/d_1$ is greater than 1.16 than it is impossible to obtain a steel cord structure that has a sufficient rubber penetration and is sufficiently round.

The steel cord structure according to the invention is round. This means that the distance 7 from the centre of the cross-section of the steel cord to the most remote point of the cross-section of steel filament 3 is about equal to the distance 8 from the centre of the cross-section of the steel cord to the most remote point of the cross-section of steel filament 2.

A steel cord is defined as having a sufficient roundness if $$0.97 \leqq \frac{\text{distance 7}}{\text{distance 8}} \leqq 1.03$$

this corresponds to $$-0.205+0.814\times d_2/d_1 \leqq d_3/d_1 \leqq -0.105+0.814\times d_2/d_1$$

The dots in FIG. 1 correspond to contacts between the different steel filaments. These contacts are line contacts along the length of the steel cord. However, these contacts are not necessarily contacts "steel-to-steel". It is possible that between some adjacent steel filaments there is a small sheath of rubber.

Figure 2:
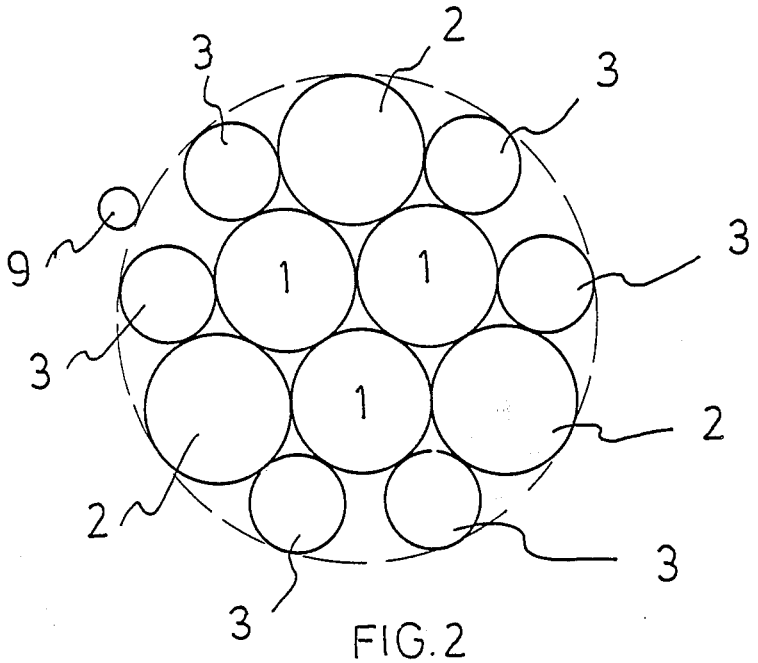
FIG. 2 represents a second example of a cross-section of a steel cord according to the invention.

FIG. 2 shows another example of a cross-section of a steel cord according to the invention:

—diameter $d_1$ of steel filaments 1 is equal to 0.28 mm

—diameter $d_2$ of steel filaments 2 is equal to 0.30 mm

—diameter $d_3$ of steel filaments 3 is equal to 0.20 mm.

The twelve steel filaments 1, 2 and 3 are twisted in the S-direction with a twist pitch of 12.5 mm. A steel filament 9 with a diameter $d_4$ of 0.08 mm is wrapped around the steel cord in the Z-direction with a pitch of 6.5 mm.

Figure 3:
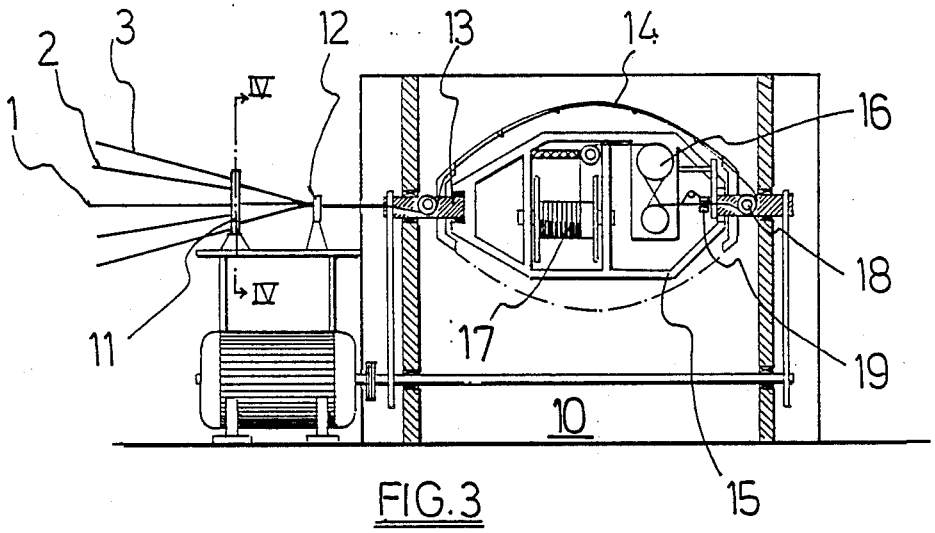
FIG. 3 represents a double-twister adapted to manufacture the steel cord according to the invention.

The steel cord can be made by a process using a conventional double-twister 10 as shown in FIG. 3. The twelve wires are unwound from a creel (not shown), pass through a guiding plate 11 and converge towards a twisting-die 12 into a bundle. Then the bundle enters axially through the rotation axis 13 of the twister, over the rotating flyer 14 back to the rotation axis on the other side, where it enters axially into the stationary cradle 15 inside the twister over capstan 16 for winding up on the bobbin 17. The capstan 16 draws the bundle from the unwinding creel through the machine.

Figure 4:
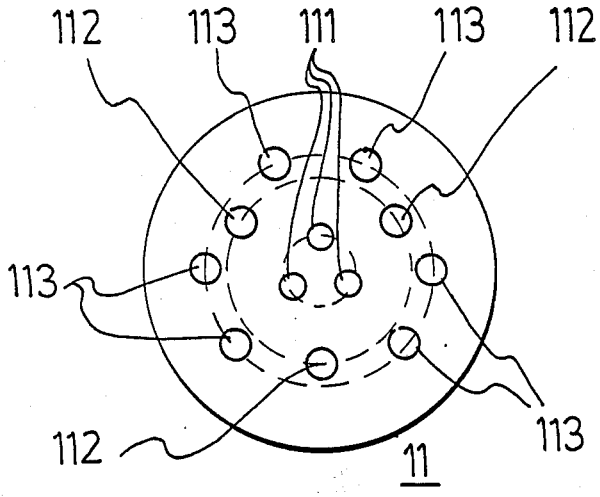
FIG. 4 represents a guiding plate of the double-twister.

If a wrapping steel filament 9 is to be provided, this can be done by a conventional wrapping machine 19 situated between pulley 18 and capstan 16. A cross-section of the guiding plate 11 along the line IV—IV is shown in FIG. 4. Holes 111, 112 and 113 guide resp. filaments 1, 2 and 3.

The rubber products comprising a steel cord according to the invention are then obtained by introducing such wires in an unvulcanized rubber composition and then vulcanizing the whole. In general, the steel cord is firstly impregnated in an adhesion rubber composition. Such adhesion rubber will conveniently comprise 40 to 70 parts of carbon black per 100 parts of rubber, 2 to 6 parts of coumarone resin, 4 to 12 parts of zinc oxide and 1 to 5 of sulphur, and further not more than 10 parts in total of antioxidant or accelerator or other agents, all parts being parts by weight.

If steel cords according to the invention are used in the belt or carcass ply of a tyre, they are laid side by side to form a foil of one or more superposed layers of cords and this foil is covered on either side with a foil of unvulcanized adhesion rubber which enters between and into the cords. The whole is cut into strips and the result is a strip of cord pieces, lying side by side in one or more superposed layers, and impregnated with unvulcanized adhesion rubber.

TEST 1

In order to show the high breaking load per cross-section of a steel cord according to the invention, 4 examples of the steel cord according to the invention are compared with a conventional compact steel cord. The twisting pitch was for all samples equal to 12.5 mm. The results are summarized in table 1.

TABLE 1

| | | | | | | Tension Test | | | |
|---|---|---|---|---|---|---|---|---|---|
| | $d_1$ (mm) | $d_2$ (mm) | $d_3$ (mm) | $d_2/d_1$ | $d_3/d_1$ | cord diameter (mm) | breaking load (N) | breaking load/ cross-section ($N/mm^2$) | filling degree (%) |
| 1 | 0.20 | 0.23 | 0.15 | 1.15 | 0.75 | 0.72 | 1050 | 2580 | 78.5 |
| 2 | 0.23 | 0.25 | 0.175 | 1.09 | 0.76 | 0.81 | 1320 | 2560 | 78.8 |
| 3 | 0.25 | 0.28 | 0.19 | 1.12 | 0.76 | 0.89 | 1560 | 2510 | 80.0 |
| 4 | 0.28 | 0.32 | 0.22 | 1.14 | 0.79 | 1.00 | 1975 | 2510 | 80.7 |
| 5 | 0.23 | 0.23 | 0.23 | 1.00 | 1.00 | 0.93 | 1600 | 2350 | 73.1 |

1, 2, 3, 4 = invention
5 = prior art

The filling degree is the percentage of the surface of the circumscribed circle which is occupied by the cross-sections of the steel filaments. As can be derived from table 1 the breaking load per cross-section is 7 percent above the breaking load per cross-section of a conventional steel cord. This is due to an optimal filling with steel.

TEST 2

A Hunter test has been developed by the Hunter Spring Company, Lansdale, Pa. See U.S. Pat. No. 2,435,772 and F. A. Volta, New wire fatigue testing method, Iron Age, Aug. 26, 1948. This Hunter test has been carried out in order to examine the behaviour of a steel cord according to the invention once embedded in rubber. A steel cord according to the invention is compared with a conventional compact steel cord and with another compact steel cord (cc=compact cord). The twisting pitch was for all samples equal to 12.5 mm. The bending stress is 400 $N/mm^2$ bare cord, the duration of the test is 3800 minutes and the rotation direction of the cord is open.

Table 2 summarizes the results as to fatigue limit and core migration.

TABLE 2

| | | | | Hunter Test | | | |
|---|---|---|---|---|---|---|---|
| | $d_1$ (mm) | $d_2$ (mm) | $d_3$ (mm) | $d_2/d_1$ | $d_3/d_1$ | dry fatigue limit of 0.23 mm filament ($N/mm^2$) | core migration |
| 1 | 0.23 | 0.25 | 0.175 | 1.09 | 0.76 | 950 | NO |
| 2 | 0.23 | 0.25 | 0.23 | 1.00 | 1.00 | 925 | YES |
| 3 | 0.20 | 0.23 | 0.20 | 1.15 | 1.00 | 975 | YES |

1 = invention
2 = conventional cc
3 = another cc

As can be derived from table 2 a steel cord according to the invention avoids core migration without loss of fatigue resistance.

I claim:

1. A steel cord adapted for the reinforcement of rubber articles, said steel cord comprising a central bundle of three twisted steel filaments (1) of a diameter $d_1$ and nine steel filaments twisted around said central bundle with the same twist pitch and twist direction as said central bundle, a first group of three steel filaments (2) of said nine steel filaments having a diameter $d_2$ and each filament of said first group contacting two adjacent steel filaments of the central bundle, a second group of six steel filaments (3) of said nine steel filaments having a diameter $d_3$ and each filament of said second group contacting both one steel filament of the central bundle and one steel filament of said first group, characterized in that the ratio $d_2/d_1$ is greater than 1.05 and smaller than 1.16 and in that the ratio $d_3/d_1$ is greater than $-0.205+0.814\times d_2/d_1$ and smaller than $-0.105+0.814\times d_2/d_1$.

2. A steel cord according to claim 1, characterized in that a single steel filament is wrapped around the steel cord.

3. A rubber product reinforced with a steel cord, characterized in that said steel cord is a steel cord according to claim 2.

4. A rubber product reinforced with a steel cord, characterized in that said steel cord is a steel cord according to claim 1.

5. A rubber product according to claim 4, characterized in that said rubber product is in the form of a tyre and that said steel cord is located in a belt or carcass ply of the tyre.

* * * * *